United States Patent [19]

Tannery

[11] 4,116,027

[45] Sep. 26, 1978

[54] DOOR LOCK

[75] Inventor: Edward F. Tannery, Coldwater, Mich.

[73] Assignee: Theodore Bargman Company, Coldwater, Mich.

[21] Appl. No.: 805,099

[22] Filed: Jun. 9, 1977

[51] Int. Cl.[2] ..... E05B 55/04

[52] U.S. Cl. ..... 70/472; 70/208; 70/481; 70/484; 292/173; 292/DIG. 31

[58] Field of Search ..... 70/472, 481–485, 70/489, 150, 152, 153, 208; 292/173, DIG. 31

[56] References Cited

U.S. PATENT DOCUMENTS

| | | | |
|---|---|---|---|
| 1,554,839 | 9/1925 | Brown | 70/150 |
| 1,855,089 | 4/1932 | Boothe | 70/483 X |
| 3,055,204 | 9/1962 | Pelcin | 70/153 |
| 3,209,564 | 10/1965 | Pelcin | 70/489 X |
| 3,487,666 | 1/1970 | Richards, Jr. | 70/150 |

*Primary Examiner*—Roy D. Frazier
*Assistant Examiner*—William E. Lyddane
*Attorney, Agent, or Firm*—Barnes, Kisselle, Raisch & Choate

[57] ABSTRACT

A door lock comprising a bolt disposed to slide axially in a frame, an outer door handle which includes an actuator extending into a cavity in the bolt, a latch disposed in the bolt cavity to slide laterally of the bolt axis between an unlock position adjacent the handle actuator and a lock position spaced laterally therefrom, and means selectively to position the latch in either the lock or the unlock position.

20 Claims, 10 Drawing Figures

FIG. 4
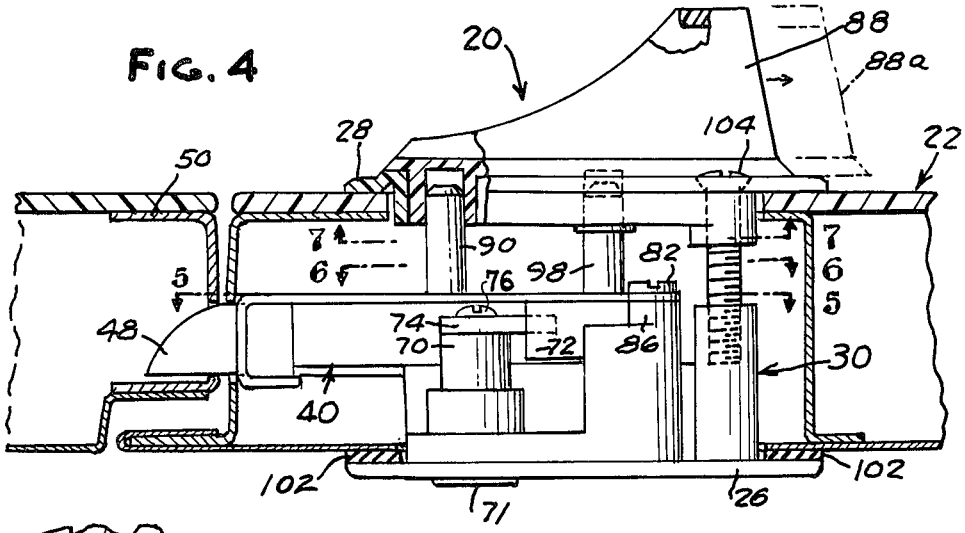
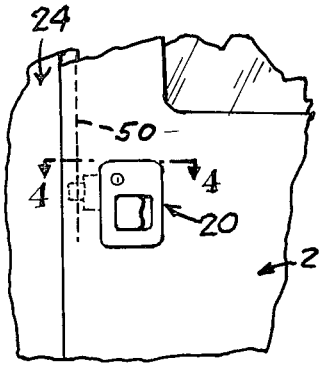
FIG. 1
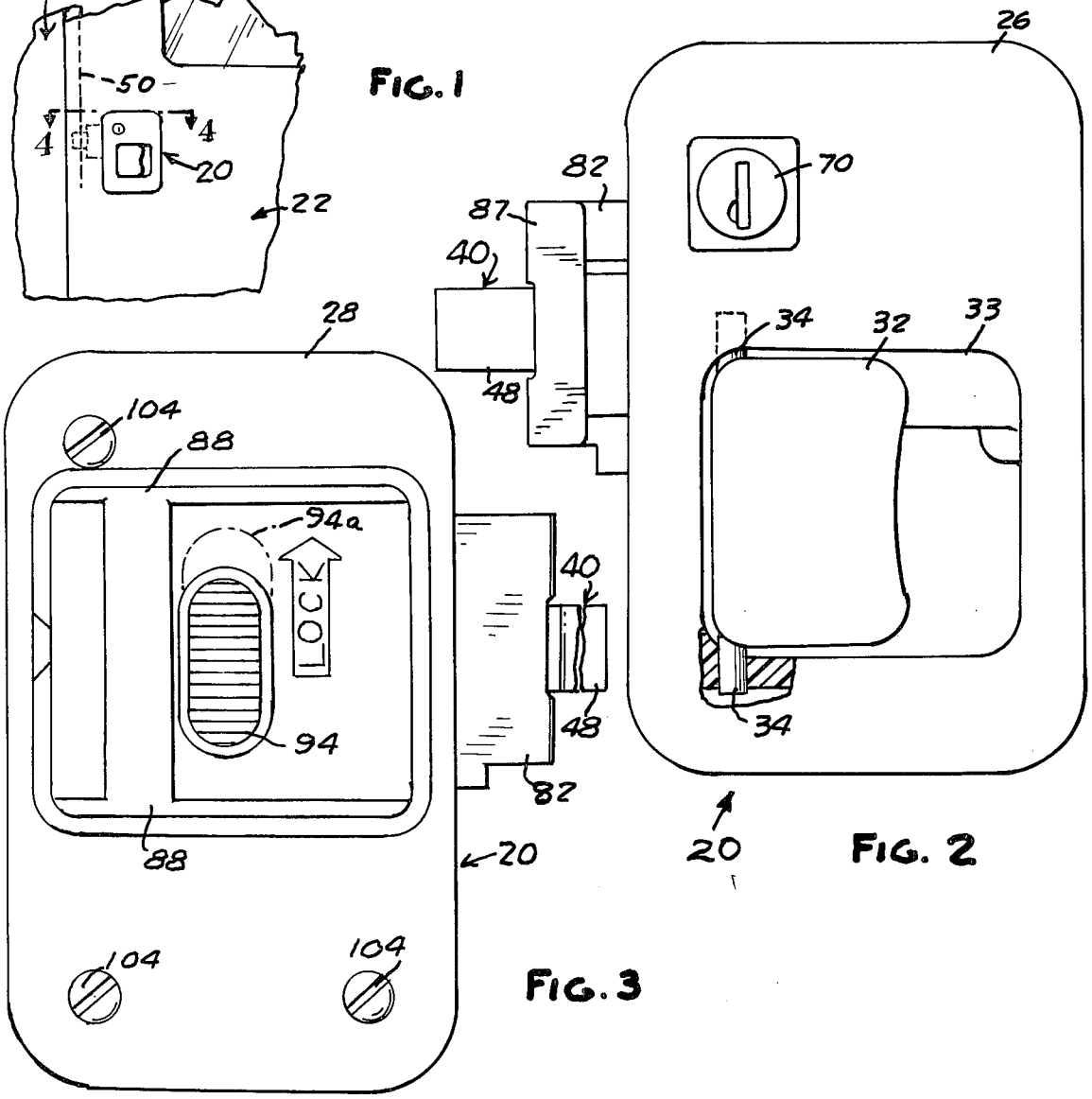
FIG. 2
FIG. 3

DOOR LOCK

The present invention relates to lock mechanisms and, more particularly, to a door lock and handle for mobile homes and similar vehicles.

Objects of the present invention are to provide a door lock which is particularly well suited for use with such vehicles, which is economical to manufacture and reliable in operation, and which has a minimum number of moving parts.

The invention, together with additional objects, features and advantages thereof, will be best understood from the following description when read in conjunction with the accompanying drawings in which:

FIG. 1 is a broken outside elevational view of a vehicle equipped with a door lock in accordance with the invention;

FIGS. 2 and 3 are respective outside and inside elevational views of a presently preferred embodiment of the invention;

FIG. 4 is a sectional view taken along the line 4—4 of FIG. 1;

Figure 9:
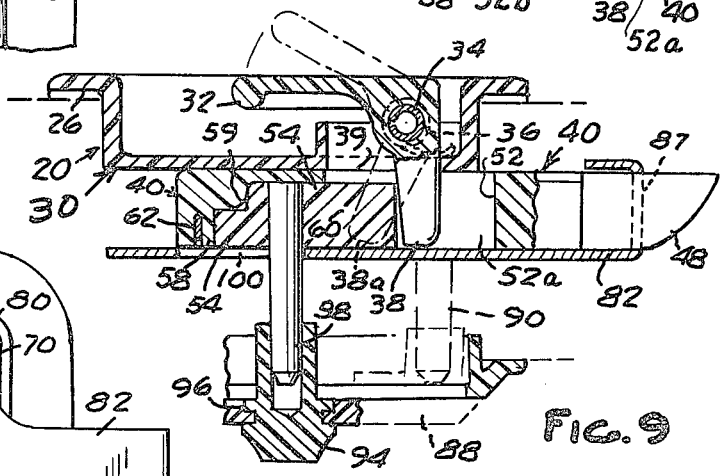
FIGS. 9–10 are partial sectional views respectively taken along the lines 9—9 and 10—10 of FIG. 5.

Referring to the drawings, a preferred embodiment 20 of the lock provided by the invention specifically adapted for use on the door 22 of a vehicle 24 (FIG. 1) includes an outer escutcheon plate 26 and an inner escutcheon plate 28 spaced therefrom by a central frame 30 (FIG. 4) which is preferably molded or cast integral with outer plate 26. The terms "inner" and "outer" or the like are relative to the inside and outside of vehicle 24. An outside handle 32 is pivotally mounted within a cavity 33 in outer plate 26 by a hinge pin 34 and is biased into a closed position flush with plate 26 by a coil spring 36 (FIG. 9). Hinge pin 34 preferably comprises a conventional roll pin which is press fitted into aligned holes in frame 30, as best seen in FIG. 2. Coil spring 36 encompasses hinge pin 34 and has spring fingers at its opposite ends which bear against lock frame 30 (FIG. 9) and the underside of the door handle (not shown). As best seen in FIG. 9, a bolt actuator arm 38 integral with handle 32 extends inwardly through a hole 39 in plate 26. Suitable sealing means (not shown) such as a synthetic silicone resin may be disposed around arm 38.

Figure 5:
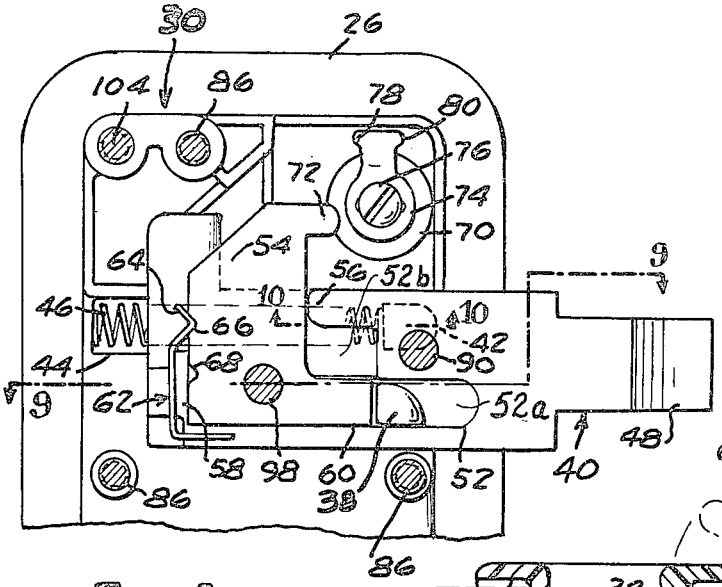
FIGS. 5–7 are fragmentary sectional views respectively taken along the lines 5—5, 6—6 and 7—7 of FIG. 4.

Referring to FIG. 5, an elongate bolt 40 has a lug 42 extending laterally of the bolt axis into a slot 44 in the lock frame which permits sliding movement of the bolt in the direction of the bolt axis. A coil spring 46 in frame slot 44 normally biases the bolt to an extended position in which the nose end 48 extends outwardly from the lock frame to cooperate with a keeper 50 in the adjacent door jamb (FIG. 4) to hold door 22 in the closed position. In accordance with the description to follow, bolt 40 may be retracted against the force of spring 46 to permit door 22 to be opened.

Figure 8:
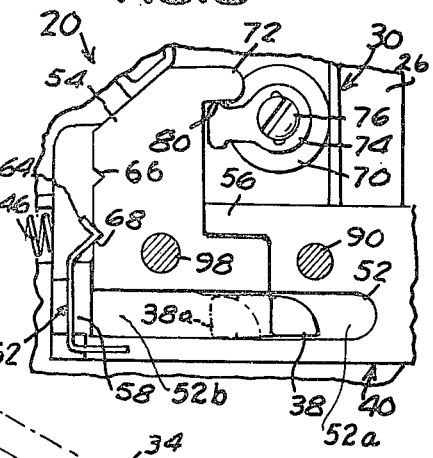
FIG. 8 is a fragmentary sectional view similar to FIG. 5 and showing the parts in a locked condition.

Bolt 40 has a generally L-shaped cavity 52 therein having portions **52*a* and 52*b*. Bolt actuator 38 on handle 32 extends into cavity 52*a* such that the handle may pivot about pin 34 in a direction generally parallel to the bolt axis, as best seen in FIGS. 8 and 9. The normal position of actuator 38 is shown in solid lines in FIG. 8 and its position when the handle is pivoted outwardly is shown in broken lines designated 38*a*. A latch 54 is disposed within cavity 52*b* and is constrained by cavity walls 56, 58 (FIGS. 5 and 8) and by a shoulder 59 (FIG. 9) for sliding movement laterally of the bolt axis between an unlock position illustrated in FIG. 5 and a lock position illustrated in FIG. 8. In the unlock position the base 60 of latch 54 is aligned with actuator 38 in the direction of the bolt axis. In the lock position illustrated in FIG. 8 latch base 60 is spaced from actuator 38 laterally of the bolt axis. A leaf spring 62 carried by bolt 40 has a V-shaped detent 64 which cooperates with notches 66, 68 in the opposing wall of latch 54 to yieldably retain the latch alternatively in the lock (FIG. 5) and unlock (FIG. 8**) latch positions.

Figure 6:
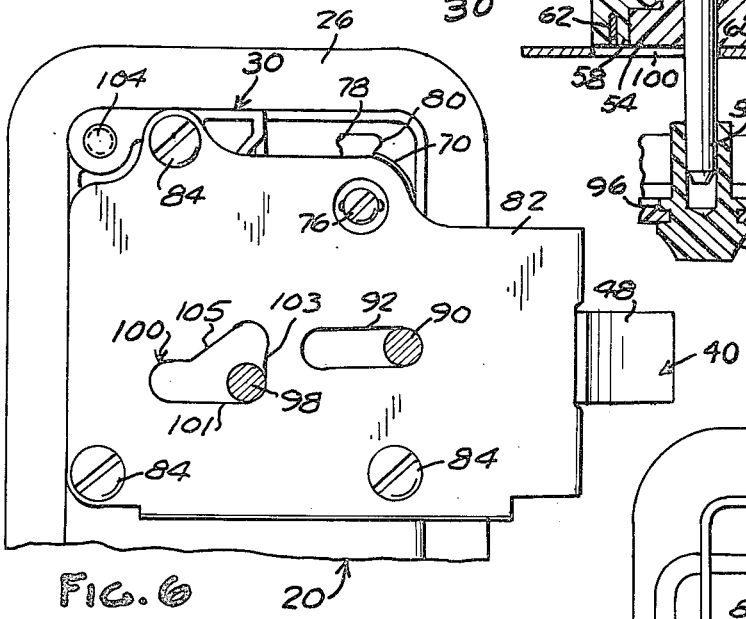
Figure 7:
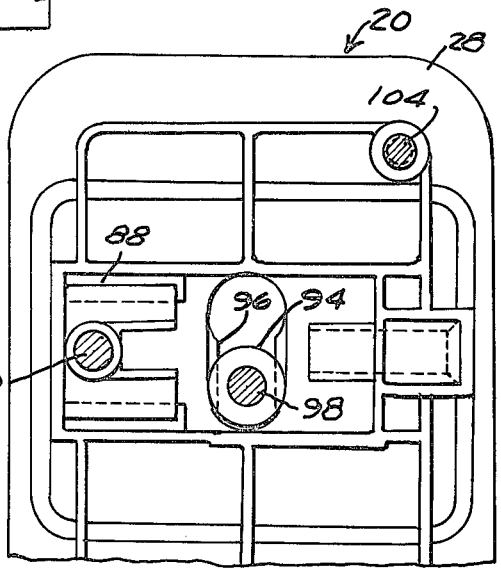

A conventional key-operated lock cylinder 70 of the type which is adapted to rotate about the cylinder axis when actuated by the appropriate key is mounted in outer plate 26 adjacent a finger 72 which extends from latch 54 in the direction of the bolt axis. A latch locking actuator 74 is affixed to the inner end of cylinder 70 by a screw 76 and extends radially therefrom. The free end of actuator 74 terminates in opposed tangential feet 78, 80. Lock cylinder 70 may be rotated clockwise, as viewed in FIGS. 5 and 8, such that actuator foot 80 cooperates with latch finger 72 to shift latch 54 laterally of bolt 40 to the lock position (FIG. 8) wherein latch base 60 is spaced laterally from actuator 38 on the outside handle in both the normal and pivoted positions of the actuator. Latch 54 will be held in the lock position by spring detent 62 until it is bodily shifted back to the position shown in FIG. 5. When cylinder 70 is rotated counterclockwise, the latch is shifted to the unlock position (FIG. 5) by the cooperative interengagement of finger 72 and actuator foot 78. With latch 54 in the unlock position, pivoting of handle 32 against the bias of spring 36 results in conjoint movement of the latch and bolt 40 to retract bolt end 48, whereby the door may be opened. A guide plate 82 (FIG. 6) mounted by screws 84 to frame bosses 86 (FIG. 4) overlies bolt 40 and latch 54 to retain them in assembled relation in frame 30. Guide plate 82 has an outwardly bent end wall 87 through which the bolt nose 48 projects.

An inner handle 88 is carried on inside plate 28 and slidable thereon in a direction parallel to the bolt axis between a normal position indicated in solid lines in FIG. 4 and a bolt-retracting position indicated in phantom at **88*a*. Handle 88 is directly coupled to bolt 40 by means of a cylindrical stud 90 press fitted at one end into a corresponding hole in the bolt and extending through a generally rectilinear slot 92 (FIG. 6) in guide plate 82 into a corresponding socket in handle 88, as best seen in FIG. 4. A lock button 94 is carried by a lip-in-slot arrangement 96 (FIG. 9) for sliding movement on handle 88 between positions corresponding to the lock (94*a* in FIG. 3) and unlock positions of latch 54. Lock button 94 is coupled directly to latch 54 by a stud 98 press fitted into latch 54 and extending through an opening 100 in guide plate 82 into a corresponding socket in button 94 (FIG. 9**).

Figure 10:
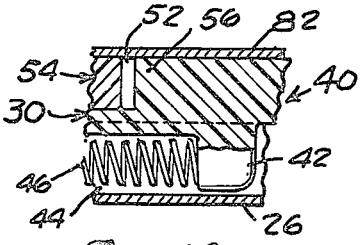

Plate opening 100 is generally shaped as a right triangle having a long horizontal edge 101 extending in the direction of the bolt axis and along which stud 98 will ride as the bolt is extended and withdrawn. Opening 100 also has a slightly convex vertical edge 103 along which stud 98 will ride as latch 54 is lifted by either button 94 or key actuator 74. Stud 98 is biased against the convex edge of opening 100 by spring 46 (FIGS. 5 and 10) so that the force of such spring must be overcome slightly as the latch is moved between the lock and unlock positions. Thus, the convex edge 103 of opening 100 cooperates with spring 46 to provide a second spring detent to hold the latch in either the lock or unlock position. The angulated edge 105 or "hypotenuse" of opening 100 cooperates with stud 98 to shift latch 54 from the lock to the unlock position as bolt 40 is retracted by inside handle 88, so that door 22 may be opened from the inside even when locked. Of course, such angulated opening edge has no effect when outside handle 82 is activated because the outside handle is coupled to the bolt only through latch 54, as hereinabove described, whereas inside handle 88 is coupled directly to the bolt by stud 90. Stated differently, the latch moves the bolt when activated by the outside handle, whereas the bolt moves the latch when activated by the inside handle. The corners of opening 100 are rounded at the radius of stud 98.

In the assembly of lock 20 to a vehicle door, outer door handle 32, spring 36 and hinge pin 34 are first assembled to the integral outer plate 26 and frame 30 as hereinabove described. Lock cylinder 70 and actuator 74 are then mounted, and spring 46, bolt 40 and the latch are fitted in place, studs 90, 98 and spring 62 having been press fitted previously into the corresponding elements. Guide plate 82 is then mounted to hold the bolt, latch and spring in place. This assembly is then fitted into a suitable opening in door 22 (FIG. 1) with a resilient gasket or seal 102 (FIG. 4) disposed between the outer rim of plate 26 and the door. The previously-assembled combination of inside plate 28, handle 88 and button 94 is then fitted over studs 90, 98 and fastened to frame 30 by the screws 104 (FIGS. 3 and 4) so that the plate 28 is positioned against the inside door trim as shown in FIG. 4 and studs 90, 98 are loosely received into corresponding pockets in handle 88 and button 94. Integral outer plate 26 and frame 30, handle 32, bolt 40, latch 54, actuator 74, inner wall 28, handle 88 and button 94 preferably are fabricated of molded plastic material or the like. The remaining components may be made from suitable steel or aluminum materials.

The invention claimed is:

1. A door lock comprising a frame, an elongate belt disposed in said frame for movement in the direction of the bolt axis, said bolt having a cavity therein and having a nose end extending outwardly beyond said frame, first means carried by said frame and extending into said cavity for movement between first and second positions generally in a direction parallel to said bolt axis, a latch disposed to slide laterally of said bolt axis within said cavity between an unlock position in which said latch is aligned with said first means in the direction of said bolt axis for abutment therewith such that movement of said first means from said first to said second position results in conjoint movement of said latch and said bolt to retract said bolt and a lock position in which said latch is spaced from said first means laterally of said bolt axis in both said first and second positions of said first means, and means for selectively positioning said latch in either said lock or said unlock position.

2. The lock set forth in claim 1 wherein said frame includes means providing a first wall adapted to be disposed adjacent one face of the door, and wherein said latch positioning means extends through said first wall to engage said latch and move said latch laterally of said bolt axis.

3. The lock set forth in claim 2 wherein said latch includes a latch finger extending from said cavity adjacent said latch positioning means, and wherein said latch positioning means comprises a lock cylinder carried by said frame and adapted for rotational movement about an axis perpendicular to said bolt axis when actuated by a key and means carried by said cylinder and adapted to engage said latch finger selectively to move said latch into and out of said lock position in accordance with the direction of rotation of said cylinder.

4. The lock set forth in claim 2 wherein said frame further includes means providing a second wall parallel to said first wall and adapted to be disposed adjacent the other face of the door, and wherein said latch positioning means comprises second means carried by said second wall for sliding movement between positions corresponding to said lock and unlock positions of said latch, and means coupling said second means to said latch for conjoint movement.

5. The lock set forth in claim 4 further comprising a handle coupled directly to said bolt and carried by said second wall selectively to retract said bolt into said frame, and wherein said frame further comprises means for cooperating with said coupling means to move said latch to said unlock position as said bolt is retracted by said handle.

6. The lock set forth in claim 2 wherein said first means comprises a first handle mounted to pivot externally of said first wall and an actuator extending through said first wall into said cavity for pivotal motion between said first and said second positions.

7. The lock set forth in claim 1 further comprising a spring detent fixedly carried by one of said latch and bolt, and notches in the other of said latch and bolt for cooperating with said spring detent to lock said latch alternatively in said lock and unlock positions.

8. The lock set forth in claim 1 further comprising a spring carried by said frame to bias said bolt such that said nose end normally extends from said frame, means carried by said frame adjacent said latch and having detent positions corresponding to respective lock and unlock positions of said latch, and means carried by said lock and biased by said spring into said detent positions in said lock and unlock positions of said latch.

9. The lock set forth in claim 1 wherein said frame includes first and second parallel lock walls; and wherein said latch positioning means comprises (1) a lock cylinder carried by said first wall and adapted to rotate when actuated by a key, a finger carried by said latch adjacent said cylinder and extending in the direction of said bolt axis and means carried by said cylinder and adapted to engage said latch finger selectively to move said latch into and out of said lock and unlock positions in accordance with the direction of rotation of said cylinder, and (2) second means carried by said second wall for sliding movement between positions corresponding to said lock and unlock positions of said latch and means coupling said second means to said latch for conjoint movement.

10. The lock set forth in claim 9 further comprising spring detent means carried by said bolt and means forming notches in said latch for selective engagement by said spring detent means to lock said latch in said lock and unlock positions alternatively, said spring detent means being overcome by force exerted on said latch through said latch positioning means.

11. The lock set forth in claim 9 further comprising a handle carried by said second wall for sliding movement in the direction of said bolt axis and means directly coupling said handle to said bolt.

12. The lock set forth in claim 11 wherein said second means is mounted on said handle for sliding movement with respect to said handle transversely of said bolt axis between said positions corresponding to said lock and unlock positions.

13. The lock set forth in claim 12 further comprising means positioned adjacent said means for coupling said second means to said latch and oriented at an angle with respect to said bolt axis for moving said latch and said second means from said lock to said unlock positions conjointly with sliding movement of said handle.

14. The lock set forth in claim 13 wherein said means for moving said latch and said second means comprises a plate carried by said frame between said bolt cavity and said second wall, said plate having (1) a generally rectilinear slot extending in the direction of said bolt axis and encompassing said means directly coupling said handle to said bolt for guiding conjoint movement of said handle and said bolt, and (2) a second opening encompassing said means coupling said second means to said latch and having a first edge extending generally in the direction of said bolt axis for guiding conjoint movement of said second means and said latch in the direction of said bolt axis when said latch is in said unlock position and a second edge angulated with respect to said first edge for guiding conjoint movement of said latch and said second means between said lock and said unlock positions in response to sliding movement of said handle.

15. The lock set forth in claim 14 wherein said second opening includes a third edge for guiding conjoint movement of said latch and said second means between said lock and unlock positions.

16. The lock set forth in claim 15 wherein said third edge is concave with respect to said opening.

17. A lock comprising an inner plate, an outer plate, a frame disposed between said plates, an elongated bolt on said frame slidable between extended and retracted positions, said bolt having a cavity therein, a latch disposed in said cavity for sliding movement transversely of the axis of the bolt between lock and unlock positions, said latch being mounted on the bolt such that movement of the latch in the bolt retracting direction causes the bolt to retract, a handle pivotally mounted on said outer plate and having an actuator thereon projecting into said cavity, said latch when in the unlock position being abutted by said actuator when the handle is actuated to retract the bolt, said actuator being in non-abuttable relation to the latch when the latch is in the lock position, a handle mounted on said inside plate for sliding movement in a direction parallel to the bolt axis, means on said inside handle engaging said bolt for retracting the bolt when the handle is slidably actuated, a latch actuator movably mounted on said inside handle engaging said latch and adapted when actuated to shift the latch between said lock and unlock positions, and cam means on said frame for shifting the latch to the unlock position in response to actuation of said inside handle in the bolt retracting direction.

18. The lock set forth in claim 17 wherein said cavity has two transversely related portions, one of said portions extending parallel to the bolt axis and accommodating said outside handle actuator when the latch is retracted by actuation of the inside handle, the other portion constraining the latch to move with said bolt and permitting the latch to shift transversely of the bolt axis.

19. The lock set forth in claim 17 wherein said cam means includes a plate fixed to said frame and having an opening therein, said latch actuator on the inside handle including a pin extending through said opening, said opening having an edge which is inclined to the bolt axis at a camming angle, said pin being disposed adjacent said edge when the latch is in said lock position whereby said edge engages said pin and shifts the latch to the unlock position when the bolt is retracted by the inside handle.

20. The lock set forth in claim 19 including key-operated means on the outside plate for shifting the latch between said lock and unlock positions.

* * * * *